United States Patent [19]

Yu

[11] Patent Number: 4,874,329

[45] Date of Patent: Oct. 17, 1989

[54] SOCKET ASSEMBLY

[76] Inventor: Kuang-Shih Yu, 10F, 546, Min Chuan E. Rd., Taipei, Taiwan

[21] Appl. No.: 261,982

[22] Filed: Oct. 24, 1988

Related U.S. Application Data

[63] Continuation-in-part of Ser. No. 97,511, Sep. 15, 1987, Pat. No. 4,781,616.

[51] Int. Cl.[4] ..... H01R 4/24

[52] U.S. Cl. ..... 439/409

[58] Field of Search ..... 439/395–426

[56] References Cited

U.S. PATENT DOCUMENTS 3,369,213 2/1968 Palmer ..... 439/409

4,529,258 7/1985 Anthony ..... 439/409

*Primary Examiner*—Joseph H. McGlynn

[57] ABSTRACT

A novel socket assembly includes: a non-conductive body with an L-shaped recess in a middle portion; two differently constructed conducting pieces separately fixed on the body and respectively having a piercing terminal portion; and a coupling member, formed in the shape of an "L," and conforming with the L-shaped recess so as to make close engagement therewith, having a chamber with an opening formed at the juncture between the horizontal portion and the vertical portion of the coupling member for the insertion of two electrical cords into the chamber, and an aperture communicated with the chamber in registry with the piercing terminal portions of the conducting pieces for exposing the electrical cords thereto; thereby, enabling an electrical connection to the quickly and conveniently made without requiring any screws.

3 Claims, 3 Drawing Sheets

SOCKET ASSEMBLY

CROSS-REFERENCE TO RELATED APPLICATION

This invention is a CIP of an application with Ser. No. 097511, filed on Sept. 15, 1987 and now U.S. Pat. No. 4,781,616.

BACKGROUND OF THE INVENTION

This invention relates to a socket assembly, more particularly to a novel socket assembly having a rotatable coupling means which can be depressed for effecting quick and convenient wire connections without requiring any screws.

Generally, socket assemblies are classified into two types—a switch control type and non-switch control type. However, whatever the type of the known socket assemblies, all wire terminals thereof are similar to each other. As shown in FIG. 1, the non-switch control type of a known socket assembly is usually the combination of a body 9, a screwshell 10 and a pair of conductive pieces 4, 5. The conductive pieces 4, 5 are respectively fastened in the screwshell 10 via a plurality of metal pins 6, wherein the conductive piece 5 is kept in contact with the screwshell 10, serving as a neutral terminal while the conductive piece 4 is positioned on the bottomside of the body 9 with its contact located in the screwshell 10, serving as a "hot" terminal thereat. Electrical cords each having a stripped end 2, 3 are respectively connected to the conductive pieces 4, 5 by a pair of screws 7, 8. The socket assembly holds a lamp bulb unit 1 which has two contacts 101, 102.

As can be seen in FIG. 1, the insulations of the electrical cords have to be stripped off at each end and the conductors of the electrical cords are hooked around the screws 7, 8 before making electrical connection with the conductive pieces 4, 5. To successfully complete the detailed procedure of making this electrical connection, a skilled worker is usually required.

In order to simplify the above-mentioned procedure, a kind of socket assembly with wire-piercing terminals has been developed. A typical structure of this socket assembly is shown in U.S. Pat. No. 4,529,258, issued to W. H. Anthony. With the improvement made by Anthony, there is no need to strip off the insulation of the electrical cords and to hook up the conductors thereof. However, the screw connection procedure for that type of socket assembly is still required in order to secure the cover to the terminal end of the body.

SUMMARY OF THE INVENTION

It is accordingly a primary object of this invention to provide a novel socket assembly having a rotatable coupling means which can be depressed to achieve an electrical connection.

It is another object of this invention to provide a novel socket assembly which has a construction simpler than that of the parent application.

According to this invention, a socket assembly includes a non-conductive body with an L-shaped recess in a middle portion fixedly connected to the screwshell at a lower end by a plurality of reveting pins. Conducting means are disposed on the non-conductive body and have two piercing terminal portions respectively connected to the screwshell and a positive terminal member for effecting electrical connections therewith. A coupling means is formed in the shape of an "L" with a horizontal portion and a vertical portion, in conjunction with the L-shaped recess, and pivotally connected to the non-conductive body so that it may be closely engaged with the L-shaped recess. A chamber is formed in the horizontal portion of the coupling means and has an opening formed at the juncture between the horizontal and vertical portions of the coupling means so that two electrical cords may be inserted into the chamber through the opening. An aperture is formed in the horizontal portion of the coupling means in registry with the piercing terminal portions of the conducting means so that the electrical cords are exposed thereto. When the coupling means is depressed to engage with the L-shaped recess of the non-conductive body, the electrical cords are moved toward the conducting means so that the piercing terminal portions of the conducting means may be inserted into the electrical cords and achieve electrical connection, respectively.

Other advantages and salient features of this invention will become clear from the following detailed description when read in conjunction with the accompanying drawings.

DETAILED DESCRIPTION OF THE PREFERRED EMBODIMENT

Figure 1:
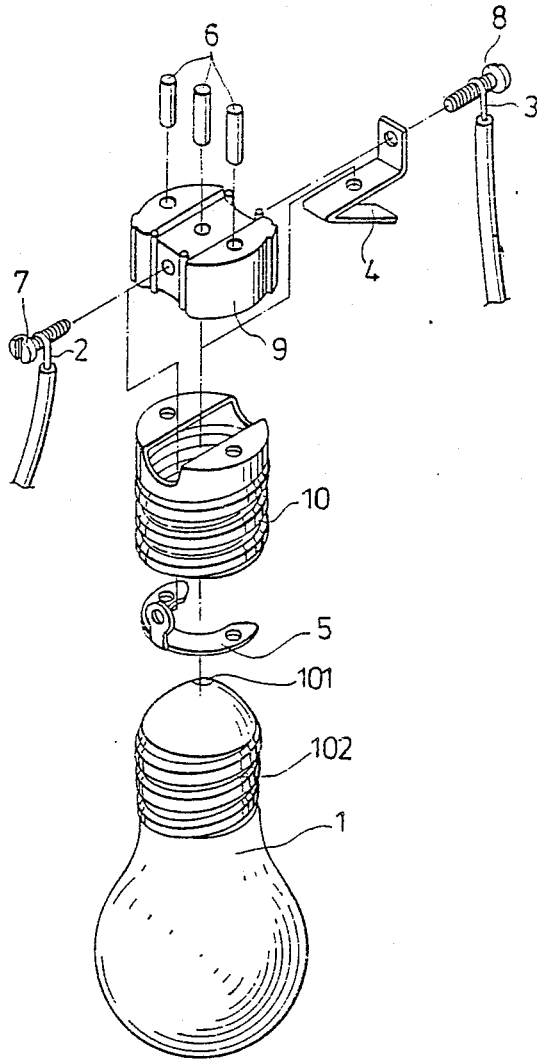
PRIOR ART FIG. 1
FIG. 1 is an exploded and perspective view of an electric lamp bulb unit and known switchless socket assembly.
Figure 2:
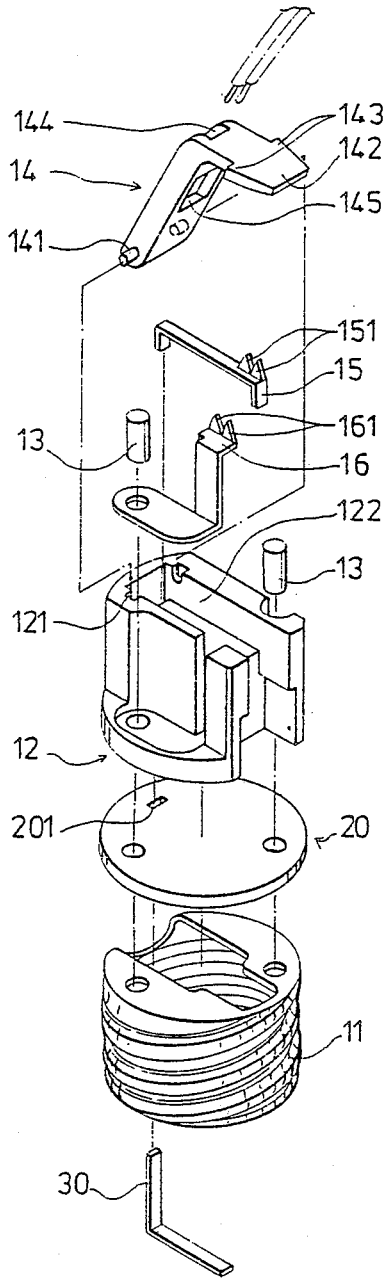
FIG. 2 is an exploded and perspective view of a preferred embodiment of a socket assembly according to this invention.
Figure 3:
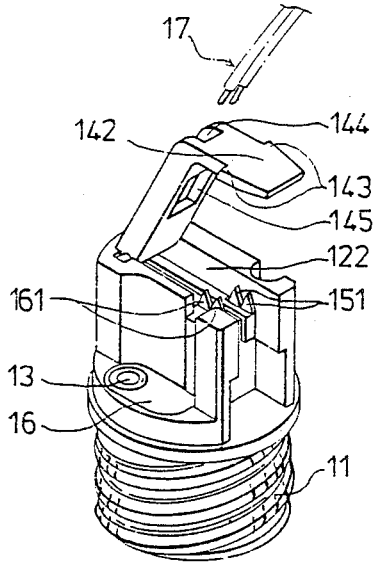
FIG. 3 is an assembled perspective view of the preferred embodiment according to this invention.

Referring to FIGS. 2 and 3, a novel socket assembly of this invention is shown. The socket assembly includes a screwshell 11 and a non-conductive body 12 which is riveted to the top of the body 12 by a pair of riveting pins 13. An L-shaped coupling means 14 is mounted pivotally on the body 12 through the engagement of the pivot pins 141 and the holes 121 of the body 12.

Figure 4:
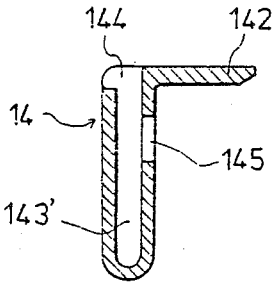
FIG. 4 is a sectional view showing the coupling means of the preferred embodiment according to this invention.

The coupling means 14 has an enlarged trapezoidal end 142 which has two barbs 143 on opposite sides thereof. The body 12 has an L-shaped recess 122 in conjunction with the coupling means 14. It is understood that the trapezoidal portion defined by the barbs 143 permits the coupling means 14 to be retained within the enlarged end of the recess 122. A conducting means includes a positive conducting piece 15 and a negative conducting piece 16 which are both fixed on the body 12 by riveting pins 13. The positive conducting piece 15 is kept in contact with a positive member 30 through the rectangular hole 201 of a circular insulating plate 20 which is interposed between the body 12 and the screwshell 11, while the negative conducting piece 16 is electrically connected to the screwshell 11 through the riveting pin 13, as shown in FIG. 3. Each of the conducting pieces 15, 16 has a serrated piercing terminal portion 151, 161. Referring to FIGS. 3 and 4, the horizontal portion of the coupling means 14 has a chamber 143' in which two parallel electrical cords 17 are received. The electrical cords 17 can be inserted into the chamber 143' through an opening 144 which is formed in at the juncture between the horizontal and vertical portions of the coupling means 14. An aperture 145 is formed in the horizontal portion of the coupling means 14 in communication with the chamber 143' and in registry with the serrated portions 151, 161 of the conducting means, so that the electrical cords 17 are exposed thereto. When the coupling means 14 is depressed to engage with the L-shaped recess 122 of the body 12, the serrated portions 151, 161 of the conducting pieces 15, 16 are separately and respectively pierced into the electrical cords 17, making electrical contact with respective conductors of the electrical cords 17.

As explained in the foregoing, the operation of the preferred embodiment includes the simple steps of inserting the electrical cords 17 into the chamber 143' of the coupling means 14 and depressing the coupling means 14 so as to engage said means with the L-shaped recess 122 of the body 12.

While a preferred embodiment has been illustrated and described, it will become apparent that many changes may be made in the general construction and arrangement of the invention without departing from the scope thereof. It is therefore desired that the invention not be limited to the exact disclosure but only to the extent of the appended claims.

I claim:

1. A socket assembly having a screwshell provided for holding an electric lamp bulb, an insulating plate for being positioned on top of the screwshell, and a positive terminal member disposed in the screwshell with one end extending through the top thereof, comprising:

a non-conductive body with an L-shaped recess in a middle portion fixedly connected to the screwshell at a lower end by a plurality of riveting pins;

conducting means disposed on said non-conductive body and having two piercing terminal portions respectively connected to the screwshell and the positive terminal member for effecting electrical connections therewith;

a coupling means, formed in shape of an "L" with a horizontal portion and a vertical portion in conjunction with said L-shaped recess, pivotally connected to said non-conductive body for enabling close engagement with said L-shaped recess, having an accommodating means therein for receiving two electrical cords while permitting the electrical cords to be exposed in registry with said conducting means, rotatable to press said electrical cords against said conducting means so that said piercing terminal portions of said conducting means may be inserted into the electrical cords and achieve electrical connection, respectively; and a retaining means for retaining said coupling means within said L-shaped recess of said non-conductive body.

2. A socket assembly as claimed in claim 1, wherein said accommodating means includes a chamber formed in said horizontal portion of said coupling means and having an opening formed at a juncture between said horizontal and vertical portions of said coupling means, and an aperture formed in said horizontal portion of said coupling means in communication with said chamber and in registry with said piercing terminal portions of said conducting means, so that the electrical cords in said coupling means are exposed to said aperture.

3. A socket assembly as claimed in claim 1, wherein said retaining means includes:

said L-shaped recess having an enlarged end; and said coupling means having an enlarged end closely engaged with said enlarged end of said L-shaped recess.

* * * * *

UNITED STATES PATENT AND TRADEMARK OFFICE

CERTIFICATE OF CORRECTION

PATENT NO. : 4,874,329

DATED : October 17, 1989

INVENTOR(S) : Kuang-Shih Yu

It is certified that error appears in the above-identified patent and that said Letters Patent is hereby corrected as shown below:

On the title page, after Primary examiner add:

Attorney, Agent or Firm:
McGlew and Tuttle, P.C.

Signed and Sealed this

Ninth Day of April, 1991

*Attest:*

HARRY F. MANBECK, JR.

*Attesting Officer*

*Commissioner of Patents and Trademarks*